United States Patent [19]

Obuch

[11] 4,176,904

[45] Dec. 4, 1979

[54] ELECTRICAL TERMINAL

[75] Inventor: Edward A. Obuch, Linden, N.J.

[73] Assignee: Amerace Corporation, New York, N.Y.

[21] Appl. No.: 838,374

[22] Filed: Sep. 30, 1977

[51] Int. Cl.[2] ..... H01R 9/00; H01R 23/00

[52] U.S. Cl. ..... 339/192 R; 339/198 S

[58] Field of Search ..... 339/198 R, 198 G, 198 GA, 339/198 S, 198 P, 198 C, 198 H, 198 M, 210 R, 210 T, 210 M, 191 R, 191 M, 192 R, 192 T, 193 R

[56] References Cited

U.S. PATENT DOCUMENTS

| | | | |
|---|---|---|---|
| 2,205,878 | 6/1940 | Eby | 339/198 S |
| 2,759,223 | 8/1956 | Del Camp | 339/192 T |
| 2,882,512 | 4/1959 | Morone, Jr. | 339/193 |
| 4,040,700 | 8/1977 | Obuch | 339/95 R |

OTHER PUBLICATIONS

Amerace Corp., Control Products Division, Agastat Control Relays, 10-1973.

Amerace Corp., Control Products Division, Agastat Control Relays, 10-1976.

Custom Connector Corp., Relay Sockets for Every Purpose.

*Primary Examiner*—Neil Abrams

*Attorney, Agent, or Firm*—S. Michael Bender; Ken Richardson

[57] ABSTRACT

A compact electrical terminal socket for use with electrical devices, such as control relays with pin contact members thereon, comprises two separable interconnected socket body sections, to wit, a top-half section mounted onto a recessed floor of a bottom-half section. The top-half section is provided with a first and second plurality of recessed terminal-receiving cavities having therein corresponding first and second pluralities of terminal contact members. The first and second plurality of recessed terminal-receiving cavities are juxtaposed relative to each other to form a symmetrical array of rows within the top-half section in a manner effective to electrically isolate and insulate the cavities from one another, and thus, to electrically isolate and insulate each terminal contact member disposed therein. The first plurality of terminal-receiving cavities are oriented within the top-half section to enable receipt of the first terminal contact members therein at a first side of the top-half section whereas the second plurality of terminal-receiving cavities are oriented within the top-half section to enable receipt of the second terminal contact members therein at a second side of the top-half section positioned between the two interconnected sections. Each first and second terminal contact member is provided with a hook-like configured pin or blade contact-receiving portion which enables it to make positive electrical connections with misaligned pin contact members of the relay when inserted therein.

22 Claims, 14 Drawing Figures

ELECTRICAL TERMINAL

BACKGROUND OF THE INVENTION

1. Field of the Invention

The present invention generally relates to an electrical device terminal socket assembly and, more particularly, to a two-piece constructed terminal socket assembly having recessed structure therein for receiving a plurality of electrical terminal contact members and for completely electrically isolating and insulating the electrical terminal contact members from one another.

2. Description of the Prior Art

Presently known electrical terminal sockets, of the type employed with control relays, for example, have common fundamental design requirements regardless of their ultimate application. The socket must adequately support, at an external face portion thereof, the mounted relay, and must include as well a high density symmetrical array of electrical terminal contact members. The terminal contact members are disposed within recessed terminal-receiving cavities which, in turn, are symmetrically aranged within the body of the socket to assure positive electrical connections with a corresponding symmetrical array of electrical male pin contacts extending from the mounted relay. Thus, the socket body, including the terminal-receiving cavities therein, is required to have structure that completely electrically isolates and insulates the retained contact-terminal members from one another, so as to prevent electrical arcing and subsequent shorting between adjacently retained terminal contact members of the array. Such electrical arcing often occurs as a consequence of many of the external electrical connections to the socket being at different voltage potentials. Also, the socket body must be designed to efficiently position the terminal plate portions of socket contact terminals so that, external conductors may readily and conveniently be connected thereto and further, so that one large number of such external connections may be made.

To meet these basic requirements, particularly those relating to the placement, isolation, and insulation of the terminal contact members housed in the socket body, the known practice is to construct the socket body from several interconnecting sectional pieces. However, the prior socket bodies constructed from several pieces may not provide the desired protection against shorting electrical arcs traveling across the several adjoining surfaces of the intermating pieces, nor do they provide desired protection against the electrical arcs which travel across the core holes and the air gaps that are necessarily present within thermoplastic constructed sockets to facilitate the molding thereof. Moreover, the manufacturing and handling of the several pieces making up the prior socket body undesirably results in an increased cost associated with tooling, production, inventory and distribution.

Additionally, it is common to support and secure control relays to the mounting surface of the socket without any help other than locking springs plus perhaps the mechanical connection between the electrical terminal contact members of the socket and electrical pin contact members of the relay. This arrangement, however, may be inadequate to prevent the relay from deleterious rocking when the relay-socket assembly is employed in high vibratory environments or is subected to severe shock. The rocking movement of the relay puts the terminal-receiving portions of the terminal contact members under additional detrimental stress, thus, causing fatigue thereof which eventually leads to loosening of the electrical connections between the terminal contact members of the socket body and the pin contact members of the relay.

Also, it is not unusual for control relays to have misaligned pin members within the array resulting from manufacturing mistolerances or abuse in use or handling. However, repetitions acts of inserting and withdrawing misaligned pin contact members, at the pin contact receiving portions of the terminal contact members, when either connecting or disconnecting the relay at the socket, puts unwanted stresses on the terminal-receiving portions of the terminal contact members. These undesired stresses cause fatigue within the terminal-receiving portions of the terminal contact members and eventual loosening or breaking of the electrical connections between the misaligned pin contact members and the terminal contact members.

To prevent the occurrence of stress produced fatigue, and the subsequent harmful loosening and breaking of terminal contact members associated therewith, terminal contact members have been constructed in a numerous assortment of different shapes or configurations, as well as constructed from a wide variety of different metal compounds. Nevertheless, conventional terminal contact members suffer disadvantages in that they have not been constructed in a configuration making them capable of neutralizing or circumventing harmful stress produced fatigue, such that, positive electrical connections between the misaligned inserted pin contacts and the terminal contact members are maintained without any loosening or breaking thereof.

Against the foregoing background, it is an object of this invention to provide a compact electrical terminal socket, which socket comprises solely two separable interconnected body sections.

It is another object of this invention to provide a compact two-piece constructed terminal socket, which socket comprises a symmetrical array of recessed first and second terminal-receiving cavities juxtaposed within the socket in a manner to completely electrically isolate and insulate each inserted terminal contact member therein from one another, by which, electrical arcing between inserted terminal contact members is prevented.

It is still an object of this invention to provide a compact two-piece constructed electrical terminal socket, which socket comprises a seating means thereon for preventing rocking displacement of the relay mounted thereon.

It is yet another object of this invention to provide a compact, two-piece constructed terminal socket, which socket comprises terminal contact members therein having contact-receiving portions thereof capable of satisfactorily accepting and retaining misaligned pin or blade contact members without loosening or breaking of the electrical connections formed thereby.

It is yet and still another object of this invention to provide a compact, two-piece constructed electrical terminal socket, which socket comprises a first plurality of terminal contact members and a second plurality of terminal contact members disposed therein, with the first plurality of terminal contact members being constructed differently from the second plurality of contact members, so as to allow for the socket body to be constructed from solely two pieces and to allow for external circuites to be connected to each contact member.

SUMMARY OF THE INVENTION

To the accomplishment of the foregoing objects and advantages, the present invention, in brief, comprises a compact, electrical terminal socket for use with electrical devices, such as, control relays having a plurality of conductor pin contacts thereon. The socket comprises two separable interconnectable socket body portions, to wit, a top-half section mounted onto a recessed floor portion of a bottom-half section. The top-half section is provided with a first and second plurality of terminal-receiving cavities therein. Each first and second plurality of terminal-receiving cavities has associated therewith a like plurality of elongated recesses. The first and second pluralities of terminal-receiving cavities are juxtaposed in a symmetrical array of rows within the top-half section in a manner to be electrically isolated and insulated from one another, and thus, to electrically isolate and insulate the terminal members disposed therein from one another.

The recessing corresponding to the first plurality of terminal-receiving cavities extend from between adjacently spaced upright barriers, which adjacently spaced upright barriers define bays, on a first side of the top-half section, for receiving therein electrical connectors from external circuits. The recesses corresponding to the second plurality of terminal-receiving cavities extend from between adjacently spaced upright barriers, which define bays on the recessed floor portion of the lower half section, for receiving therein additional electrical connectors from external circuits.

The first plurality of terminal-receiving cavities within the array, including its related recesses and bays, are oriented to enable receipt of first terminal members therein from the first side of the top-half section, while the second plurality of the terminal-receiving cavities, including its related recesses, are oriented within the array to enable insertion therein of second terminal members at a second side of the top-half section between adjoining surfaces of the interconnected top and bottom-half sections.

All of the first and second terminal contact members are provided with a hook-like configured contact-receiving portion offset with respect to a strap portion and terminal plate portion thereof. The hook-like configured contact receiving portion of the terminal contact member enables it to receive and make positive electrical connections with misaligned pin contact members of the mounted relay without loosening or breaking. The second terminal contact members are provided with elongated strap portions of a length greater than that of the first of terminal contact members, as well as with return loop portions not included in the first terminal contact members. By this arrangement, the socket need have only two sections with both the first and second terminal contact members being insertable into the recessed terminal-receiving contacts, recesses and bays associated therewith at the first and second sides, respectively, of the top-half section.

BRIEF DESCRIPTION OF THE DRAWINGS

The foregoing and still other objects and advantages of the present invention will be made more apparent from the following detailed description explanation of the preferred embodiments of the invention in connection with the accompanying drawings.

DETAILED EXPLANATION OF THE PREFERRED EMBODIMENTS OF THE INVENTION

Figures 1, 2, 4:
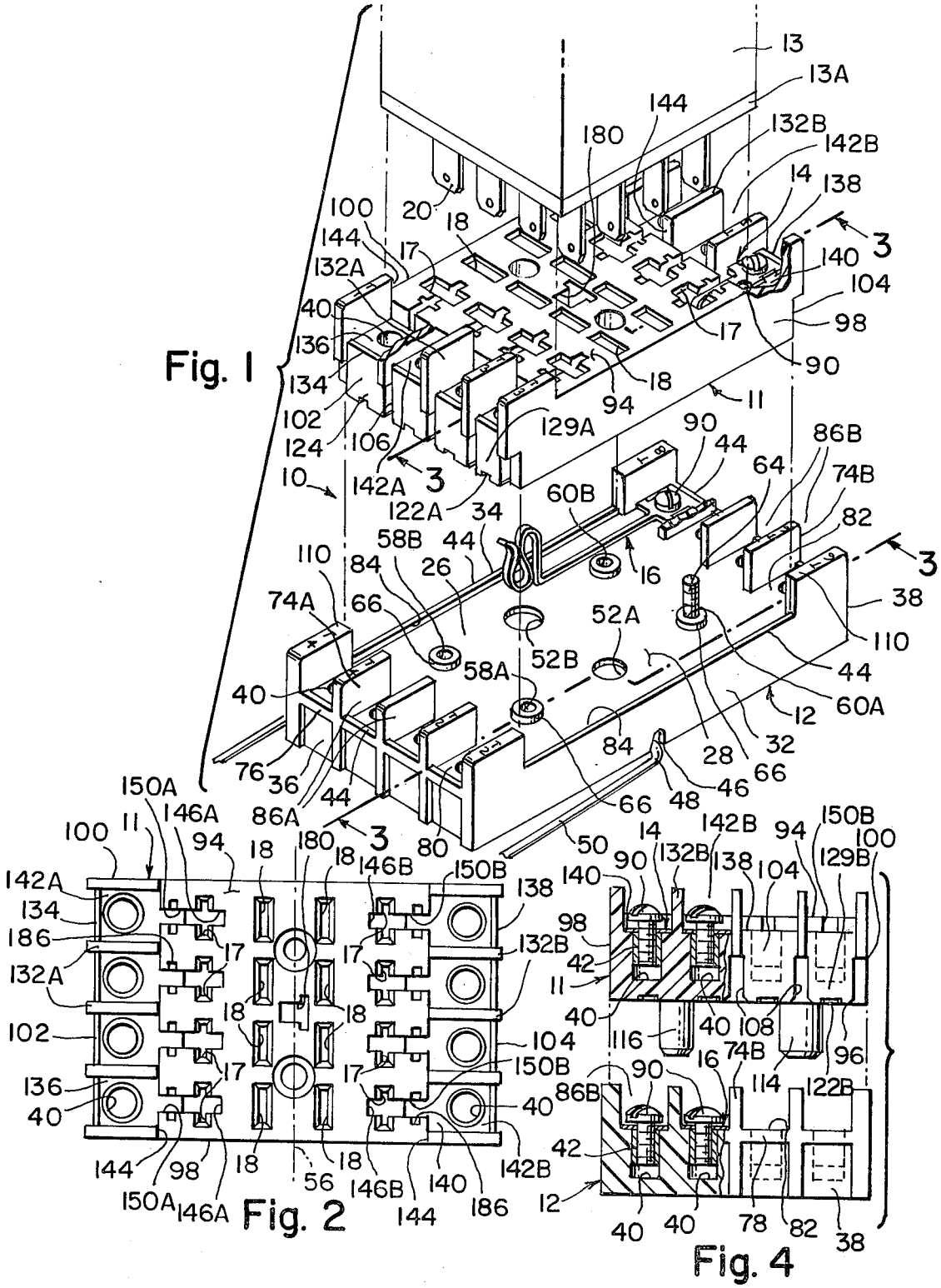
FIG. 1 is an exploded perspective view illustrating an electrical terminal socket constructed in accordance with the invention for use with an electrical control relay shown partially broken away.
FIG. 2 is a top view of the electrical terminal socket of FIG. 1.
FIG. 4 is an exploded end view, partly in section, of the electrical terminal socket of FIG. 1.

Referring initially to FIG. 1, there is shown a preferred form of the present invention comprising an electrical terminal socket assembly generally indicated by the reference numeral 10, and comprised of a top-half section 11 and a bottom-half section 12 adapted to be intermated or interconnected together as will be made more evident below. Socket 10 is applicable for use with an electrical device, having pin or blade contact members thereon, and is preferably used with a control relay 13, the bottom portion of which is illustrated in phantom lines. To this end, socket 10 is provided with a first plurality of electrical terminal contact members or clips 14 and a second plurality of electrical termimal contact members or clips 16 with each of said terminal contact members being inserted or received in a corresponding cavity having an opening in the top surface of the upper-half section 11 of socket 10.

The opening of each cavity preferably has a shape complementary to the shape of a corresponding pin or blade contact member 20 extending from the bottom portion of control relay 13. Thus, the terminal contact members 14 are adapted to be received in their corresponding cavities which latter have corresponding openings 17 disposed in two sets of four each within the top surface of upper-half section 11 as shown in FIG. 2 whereas the terminal contact members 16 are adapted to be received in their corresponding cavities which latter have corresponding openings 18 also disposed in two sets of four each within the top surface of upper half section 11 as shown in FIG. 2. Together, openings 17, 18 define a substantially symmetrically disposed array of sixteen in number which corresponds to a like numbered array of pin or blade contact members 20 extending from the bottom of relay 13. By this arrangement the pin or blade contact members 20 of control relay 13 may be inserted into and through the complementary shaped openings 17, 18 within the top surface of upper-half section 11 of socket 10 and be received within a corresponding first or second electrical terminal contact member 14, 16 disposed within corresponding cavities within the upper-half section 11 of socket 10.

It will be appreciated that the specific details of control relay 13 form no part of the present invention and that this relay may comprise any well known type suitable for example, for light current and logic switching operations such as the model GPK control relay available from Amerace Corporation under the trademark AGASTAT. In the preferred embodiment described, the control relay 13, as indicated above is one which has a symmetrical sixteen pin or blade contact member arrangement comprising four rows of evenly spaced pin or blade contact members 20, four to each row.

The top-half section 11 and bottom-half section 12 of socket 10, are preferably fabricated by molding in a known manner and to the shape substantially shown, from a synthetic polymeric electrically insulating material, such as nylon, polyproplene, or phenolic. Thus, the term "synthetic polymeric material" as used herein is to be construed to cover both thermoplastic and/or thermoset materials. Although socket 10 is preferably molded from such synthetic polymeric materials, it should be understood that other suitable materials having adequate insulating and strength characteristics upon being molded or otherwise formed may be employed, as will occur to those skilled in the art.

In accordance with the preferred embodiment, as is illustrated in FIGS. 1 through 6, both top-half section 11 and its interconnecting bottom-half section 12 have a general overall rectangular slab-like shape. Bottom-half section 12 is provided with floor 26 having a top surface 28 for supporting thereon tophalf section 11. Floor 26, also has a bottom surface 30, and is surrounded or supported by two lateral sidewalls 32 and 34 and two end sidewalls 36 and 38.

Figure 6:
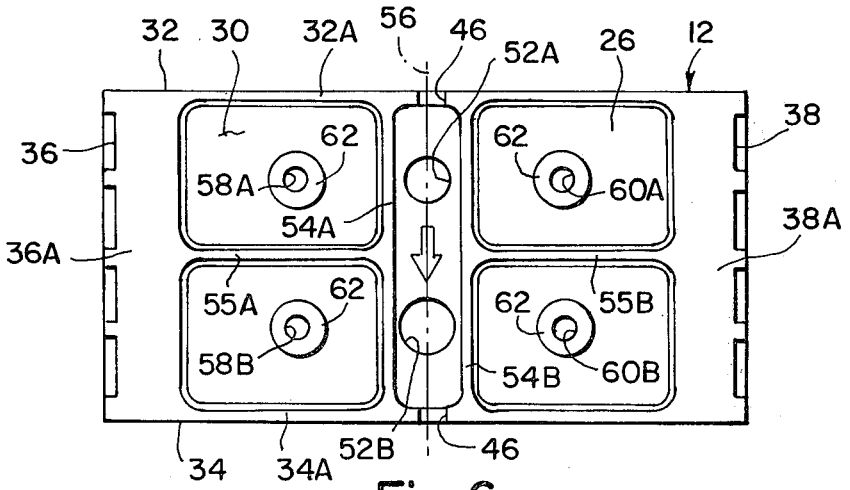
FIG. 6 is a bottom view of the bottom-half section of the electrical socket of FIG. 1.

Each lateral sidewall 32 and 34 and each end side wall 34 and 36 extends in a direction vertically downward from bottom surface 30 of floor 26 and terminates in a relatively narrow flat-bottomed edge or border, designated as 32A, 34A, 36A and 38A, respectively (see FIG. 6). Each flat-bottomed edge 32A and 34A of sidewall 32 and 34, respectively, and each flat-bottomed edge 36A and 38A of end sidewalls 36 and 38, respectively, are of sufficient width to provide a base or foundation surface for supporting relay 13 on socket 10. It is observed that the flatbottomed edges 36A and 38A are wider or thicker than flat-bottomed edges 32A and 34A. This is so as end sidewalls 36 and 38 are fabricated to be of sufficient thickness or width to satisfactorily accommodate therein, at upper surface 28, a plurality of transversely spaced partially recessed apertures 40. Apertures 40, in turn, are adapted to receive therein respectively a conventional female or internally threaded insert 42, each having a plurality of longitudinally extending ridges thereon, for retaining the insert 42 in its respective aperture 40 in a well known manner.

Also, each lateral sidewall 36 and 38 defines a slightly elevated narrow rim or ridge 44, of uniform thickness, around the perimeter of floor 26, such that, upper surface 28 of floor 26 is effectively recessed or enclosed within the elevated rim 44 of lateral sidewalls 32 and 34 and end sidewalls 36 and 38. Additionally, each lateral sidewall 32 and 34 is provided with an inverted generally "U" configured through slot or groove 46 at a section intermediate their opposed distal extremeties. Each through slot 46 is adapted for receiving and retaining therein a corresponding removable end 48 of a conventional locking spring 50 partially shown in FIG. 1.

Figure 3:
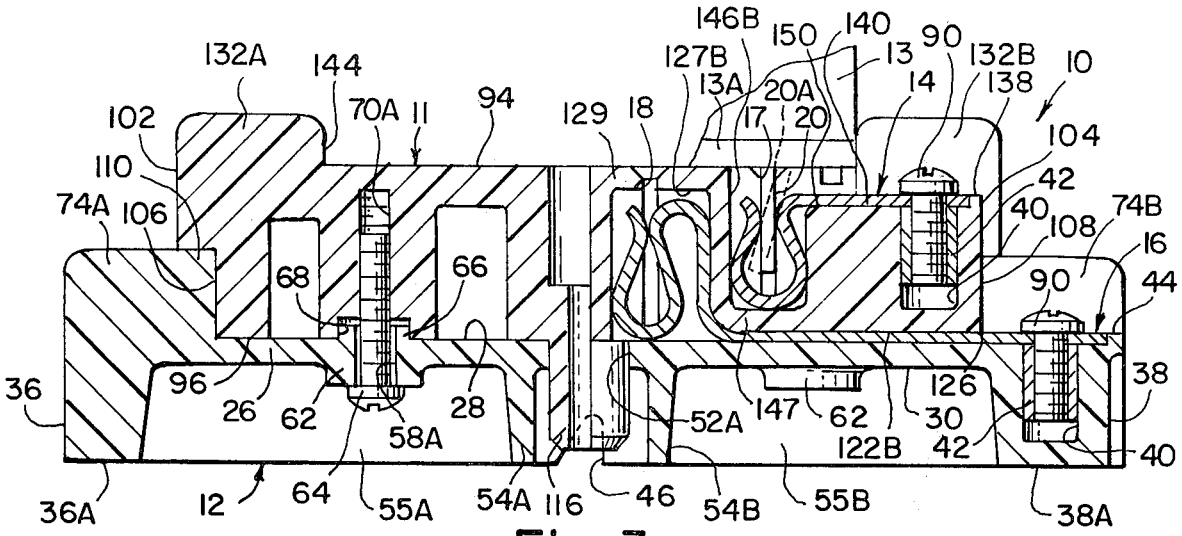
FIG. 3 is a side view in section of the electrical terminal socket of FIG. 1 in assembled condition taken along lines 3—3 of FIG. 1.

Referring to FIGS. 3 and 6, floor 26, including lower edges 32A, 34A, 36A and 38A, affords half section 12 with a closed back construction, except for a substantially symmetrical array of six through apertures extending through floor 26. The six apertures are arranged in three parallel spaced rows of two apertures each. An intermediate row includes two spaced through apertures 52A and 52B centered on a transverse center line 56 of bottom-half section 12. The through apertures 52A and 52B are provided with different diameters for a purpose which will be made more apparent below.

A pair of end rows of through apertures are positioned astraddle or outboard with respect to the intermediate row with each of said pair containing a pair of transversely spaced through apertures 58A, 58B and 60A, 60B, respectively. Each through aperture 58A, 58B, 60A and 60B is disposed in a corresponding boss or sleeve 62, extending from bottom surface 30 of floor 26. Each boss 62 is of sufficient height and diameter to seat thereon the head of a mounting screw 64 that is to be inserted into each through aperture 58A, 58B, 60A, and 60B respectively, from the direction of bottom surface 30 during interconnection of the top-half and bottom-half sections of the socket.

Figure 5:
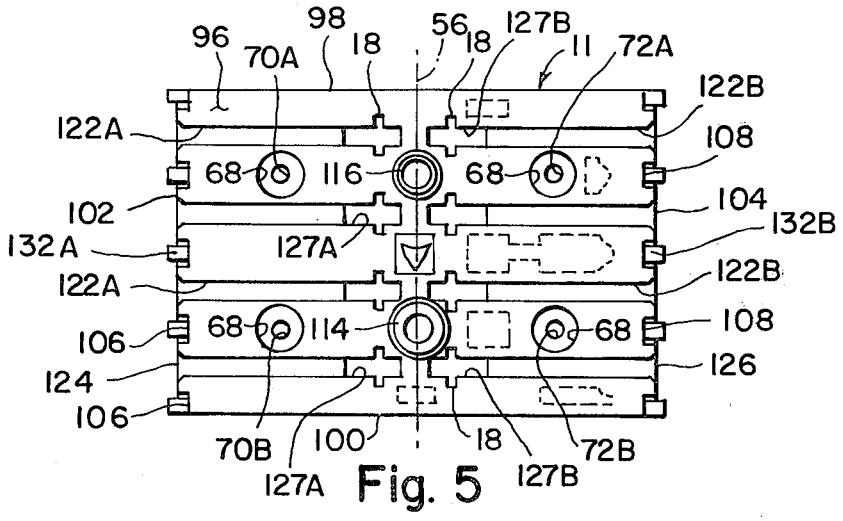
FIG. 5 is a bottom view of the top-half section of the electrical terminal socket of FIGS. 1 and 2.

Similarly, at top surface 28, each aperture 58A, 58B, 60A and 60B is also disposed in a sleeve or boss 66, extending upward from top surface 28. Additionally, each boss 66 is of sufficient height and diameter to be received within the counterbore 68 of a corresponding internally-threaded recess 70A, 70B, 72A, and 72B provided in the top-half section 11 substantially as shown in FIGS. 3 and 5.

Turning to FIGS. 3 and 6, a pair of parallel, spaced, walls or partitions 54A, 54B are provided transversely extending between sidewalls 32 and 34. In addition, a pair of similar walls or partitions 55A, 55B extend longitudinally between end wall 36 and wall 54A on the one hand, and between end wall 38 and wall 54B on the other hand. The walls or partitions 54A, 54B, 55A, and 55B divide the bottom surface 30 of floor 28 into separate compartments or bays effective to isolate and insulate through apertures 58A, 58B, 60A, and 60B from each other and from the pair of through apertures 52A, 52B. In addition, these walls or partitions have free edges which preferably are coplanar to edges 32A, 34A, 36A and 38A thus to provide increased supporting area or footprint for the socket.

The upper surface 28 of floor 26 is provided with two sets of transversely spaced relatively thin generally rectangular shaped upright barriers or ears 74A, 74B. Barriers 74A originate at border edge 76, formed by the intersection of floor 26 and end sidewall 36, and extend longitudinally inwardly therefrom along a border surface 80 of top surface 28 which border surface is defined by the longitudinal extent of each upright barrier 74A thereon. Likewise, the other set of barriers 74B originate at border edge 78, formed by the intersection of floor 26 and sidewall 38, and extend longitudinally inwardly therefrom along a border surface 82 of upper surface 24, which border surface 82 is defined by the longitudinal extent of each upright barrier 74B thereon. Hence, it is to be appreciated that the two sets of barriers 74A, 74B are longitudinally spaced from one another, by virtue of each plurality of upright barriers 74A and 74B being located at different borders 80 and 82 respectively, and that the adjacent barriers within each set 74A and 74B are transversely spaced from one another. It is to be further appreciated from the aforesaid structure that a rectangular shaped recess or pan 84, for receiving therein the bottom portion of top-half section 11, is formed within vertical confines, defined by the elevated ridge portions 44 of lateral sidewalls 32 and 34, and the longitudinally spaced two sets of upright barriers 74A and 74B.

It is to be yet further appreciated that adjacently positioned barriers within each set of barriers 74A and 74B define open-channel configured bays 86A, 86B which are of a height sufficient to insulate the plate portion of terminal contact members 16 from one another, when the latter are situated in the bays as will be made more apparent below. Additionally, each bay 86A, 86B is also of a size suitable for surrounding the recessed apertures 40, their female threaded inserts 42, which latter in turn, are adapted to cooperatively receivingly engage conventional terminal screws 90, (as is best seen in FIGS. 3 & 4) and a corresponding external conductor connected to each terminal screw.

Intermating top-half section 11 is provided with a generally rectangular configuration that is complementary to the internal configuration of pan 84, such that, the bottom portion of upper-half section 11 is enabled to be nestled between barriers 74A, 74B and ridge 44 and seated within pan 84. Further, top-half section 11 is provided with an upper seating surface 94 and a lower mating surface surface 96 joined by lateral sidewalls 98 and 100 and end sidewalls 102 and 104.

Each end sidewall 102 and 104 of top-half section 11 contains thereon a plurality of transversely spaced recessed rectangular configured slots 106 and 108, respectively. Each plurality of slots 106 and 108 extends vertically with respect to the lower external face portion of its related end sidewall 102 and 104. Each slot 106 is of a height, depth, and width suitable for receiving therein an inner edge portion 110, with respect to transverse center line 56, of a corresponding barrier 74A, when top-half section 11 is seated in pan 84. Likewise, each slot 108 is of a height, depth and width suitable for receiving therein inner edge portion, with respect to center line 56, of a corresponding barrier 74B, when top-half section 11 is seated in pan 84. Conversely, each barrier 74A,74B associated with end sidewalls 36 and 38, respectively, is of a height or elevation above floor 26, as well as thickness, and longitudinal length, to slidably enter slot 106 and 108 corresponding therewith when top-half section is seated within pan 84.

Lower mating surface 96 carries a pair of transversely spaced, hollow cylindrical hubs or guiding pins 114 and 116 each centered along transverse center line 56 and each depending downwardly from lower mating surface 96 as best seen in FIGS. 3 and 4. One of the guiding pins 114 is provided with an external diameter that is larger than the other guiding pin 116. During interengagement of top-half section 11 with bottom-half section 12 each guide pin 114 and 116 is positioned or aligned relative to lower mating surface 96 to enter into its complementary through aperture 52A, 52B in floor 26, each of which apertures has an internal diameter suitably sized for permitting entry of the corresponding guide pin therein, when top-half section 11 is seated within pan 84.

As described above, lower mating surface 96 comprises two rows of transversely spaced internally-threaded, apertures 70A, 70B and 72A, 72B, respectively, which aforesaid apertures have internal diameters suitable for receiving therein a corresponding boss 66 carried on upper surface 28 of floor 26. To this end, the apertures 70A and 70B and 72A and 72B are suitably positioned or aligned on lower mating surface 96 relative to each corresponding boss 66 carried by bottom-half section 12 so as to permit entry therein of corresponding ones of bosses 66, when top half section 24 is seated within pan 84.

Additionally, lower mating surface 96 of top-half section 11 has provided therein two sets of transversely spaced, longitudinally extending, relatively narrow, shallow recesses 122A, 122B suitably sized with respect to width, length and depth, for receiving therein corresponding elongated strap portions of terminal contact members 16. Each one of the recesses 122A and 122B originates at one of the border edges 124 and 126, respectively, which edges are formed by lower mating surface 96 intersecting with end sides 102 and 104, respectively, and opens into a corresponding terminal-receiving cavity 127A and 127B within top-half section 11.

As best seen in FIG. 3, each cavity 127A, 127B is bounded at its upper end by a roof portion 129 through which extends an opening 18 which latter, as mentioned, above has a shape complementary to the shape of the pin or blade contacts 20 on relay 13. In the preferred form illustrated, the longitudinal dimensions of opening 18 is at right angles to the longitudinal dimension of its corresponding cavity 127A, 127B and consequently opening 18 extends into the opposed side walls of each cavity as shown in FIG. 5. Thus, as viewed in FIG. 5, each relay pin opening 18 and its associated cavity 127A, 127B assumes a substantially cruciform shape.

It will be appreciated further that each cavity 127A, 127B and its associated recess 122A, 122B are oriented within lower mating surface 96, such that, a terminal contact member 16 may be received therein. Accordingly, when the complementary pin or blade contact members 20 of relay 13 are introduced into cavities 127A and 127B through openings 18 they will engage respective hook-like extremities of the terminal contact members disposed within each cavity 127A,127B.

It is also noted that each passage of the two sets of recesses 122A and 122B is positioned or aligned upon lower mating surface 96 to relate with a corresponding single bay 86 of floor 26 when the top-half section 11 is mated to the bottom-half section 12. That is to say, each recess 122A, 122B exits through a corresponding portion 129A, 129B of end walls 36, 38 which is received between adjacent barriers 74A, 74B by virtue of the barriers 74A, 74B being received into slots 106, 108 when the socket is assembled and therefore a channel or opening is provided via each recess 122A, 122B, between contiguous surfaces, to wit, lower mating surface 96 and upper surface 28 when top-half section 11 is seated in pan 84, which channel or opening extends between a terminal-receiving cavity 127A, 127B and a corresponding bay 86.

Upper seating surface 94, of top-half section 11, is also provided with two sets of transversely spaced relatively thin, upright, generally rectangularly shaped barriers or ears 132A, 132B. Barriers 132A originate near corner edge 134, and extend longitudinally inward toward centerline 56 along a border surface 136 which is recessed relative to seating surface 94 and which is defined by the longitudinal extent of each upright barrier 132A thereon. Likewise, the other set of barriers 132B originate near corner edge 138, and extend from corner edge 138 partly inwardly along similarly recessed border surface 140, defined by the longitudinal extent of each upright barrier 132B thereon.

It is to be observed that adjacently positioned barriers 132A, 132B within each set define open channel configured bays 142A, 142B on either longitudinal extremity of seating surface 94 of top-half section 11. Each bay is recessed from or positioned below a remaining seating surface 94, by virtue of each of said barriers 132A and 132B being formed on recessed border portions 136 and 140 of seating surface 94, respectively. Also, each bay includes disposed in surface 136 or 140 as the case may be, a partially recessed aperture 40 including a conventional female threaded insert 42 for engaging a conventional male threaded terminal screw 90 substantially as shown in FIGS. 2 and 4. It will be noted that each bay 142A, 142B is of sufficient depth, length, and height to surround a strap portion of a corresponding terminal contact member 14, in engagement with a corresponding terminal screw 90 and an external conductor as will be further described below.

The inner longitudinal edge portions 144 of each barrier 132A, 132B are elevated above or are higher than seating surface 94 such that the inner longitudinal edge portions 144 form a pair of parallel rows of shoulders each of which is disposed at a respective longitudinal extremity or edge of seating surface 94. As a consequence of this arrangement, a base portion 13A of relay 13, when mounted onto socket 10, is enabled to be snuggly nestled or sandwiched between the rows of shoulders thereby preventing lateral rocking displacement of the relay relative to seating surface 94.

Referring to seating surface 94, in addition to the aforementioned series of openings 18, there is provided additional rows of similar openings 17 which extend into and intersect corresponding terminal contact member receiving cavities 146A, 146B. As seen in FIG. 2, the two rows of openings 17 are positioned relative to the two rows of openings 18 to form a substantially symmetrical array within seating surface 94. Each cavity 146A, 146B extends downwardly relative to seating surface 94 and is bounded by a floor portion 147 (FIG. 3). As in the case of openings 18 and cavities 127A, 127B, openings 17 longitudinally extend substantially at right angles to the longitudinal dimension of cavities 146A, 146B and into the opposed side walls of the latter to form a substantially cruciform shape as viewed in FIG. 2. Extending longitudinally outwardly with respect to center line 56 is a corresponding series of transversely spaced, relatively narrow, shallow recesses 150A, 150B each of which is adaptable with respect to width, depth, and length for receiving therein a corresponding strap portion of terminal contact member 14. Each one of the recesses 150A, 150B extends from a corresponding cavity 146A, 146B and exits into a corresponding bay 142A, 142B, with the floor of each recess 150A, 150B being substantially coplanar or flush with surfaces 136, 140 enclosed within bays 142A, 142B.

Since each terminal contact member receiving cavity 146A, 146B and its associated recess 150A, 150B are disposed within surface 94 of top-half section 11, the terminal contact members 14 are inserted therein from a direction above and through the surface 94 as are pin contact members 20 of relay 13. Each pin contact 20 when so inserted through a corresponding opening 17 then is adapted to engage the hook-like extremity of each terminal contact member 14 disposed in its respective cavity 146A, 146B.

In regard to the foregoing, and as shown in FIG. 3, each cavity 146A, 146B which receives or is loaded with a terminal contact member 14 from above through seating surface 94, is juxtaposed within top half section 11, with respect to a neighboring cavity 127A, 127B which latter receives or is loaded with a terminal contact members 16 from a direction below and through mating surface 96, so as to form the aforementioned symmetrical array comprising sixteen terminal-receiving openings and cavities arranged in four evenly spaced rows in surface 94, i.e. the top surface of top-section 11.

In accordance with the preferred embodiment, as illustrated in FIGS. 1, 3, and 7 through 13, socket 10 is provided with differently shaped electrical terminal-clip contact members 14 and 16. Both terminal contact members 14 and 16, preferably are formed from a single flat strip of spring tempered conductive metal, preferably that of a nonferrous material, and generally comprise a contact-receiving portion 152, 152A, a strap portion 154, 154A, and a conventional terminal plate portion 156. In each terminal contact member 14 and 16, terminal plate portion 156 is used in connection with a conventional terminal screw (e.g. screw 90, FIG. 3) for detachably connecting conductive elements thereto from external circuits and has a generally rectangularly shaped configuration. The specific structure of terminal plate 156 is well known and fully described, for example, in U.S. Pat. No. 4,040,700 incorporated herein by this reference. However, in brief, the specific structure thereof comprises, inter alia: laterally extending spaced serrations 158 positioned on an upper surface thereof; a pair of up-stuck resiliently biased tangs 160; and a through aperture 162 therein, for receiving a corresponding terminal screw 90.

Figure 7:
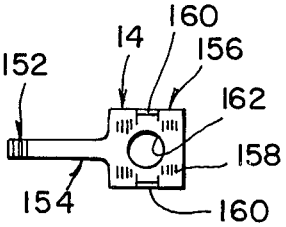
FIG. 7 is a top view of a preferred form of a first electrical terminal contact member employed in the top-half section of the electrical socket of the invention.
Figure 8:
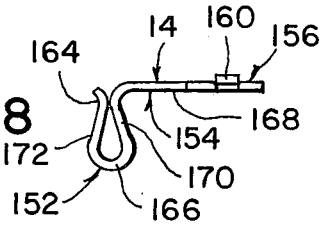
FIG. 8 is a view in elevation of the electrical terminal contact member of FIG. 7.

Referring particularly to FIGS. 7 and 8 to terminal contact member 14, notably, strap portion 154 thereof extends longitudinally between terminal plate portion 156 to merge with contact receiving portion 152, and is of a width, length, and thickness complementary to the length, width and depth of recesses 150A, 150B so as to be received therein.

Contact-receiving portion 152 of terminal contact member 14 has a hook-like shape with a fairly narrow neck section 164 and a fairly wide bowl section 166. Contact-receiving portion 152 is offset or oriented substantially perpendicular with respect to strap portion 154 and terminal plate portion 156 such that, the contact-receiving portion 152, that is, neck section 164 and bowl section 166 is positioned virtually below a bottom surface 168 of strap portion 154 and terminal plate portion 156.

To this end, a first jaw segment 170 of the contact-receiving portion 152 extends downward at nearly a right angle from strap portion 154, and merges into a first concave curve from which it merges or extends into a first convex curve. From a base of the convex curve, first jaw segment 170 reverses its direction and extends upwards as second jaw 172 towards strap segment 154 and merges into a second concave curve. Hence, jaw segments 170 and 172 are bowed towards one another in a concavo-concave configuration to form neck section 164 of contact-receiving portion 152, and are bowed away from one another in a convexo-concave configuration to form bowl section 166 of contact-receiving portion 156.

Figure 9:
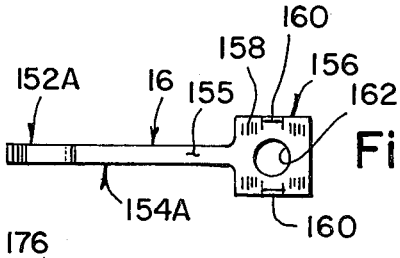
FIG. 9 is a top view of a preferred form of a second electrical contact member employed in the top-half section of the electrical terminal socket of the invention.
Figure 10:
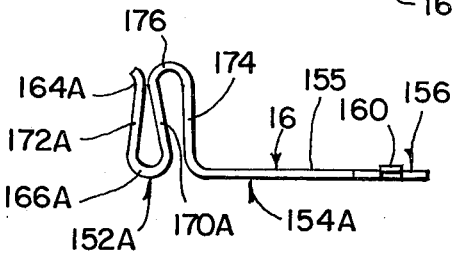
FIG. 10 is a view in elevation of the electrical terminal contact member of FIG. 9.
Figure 11:
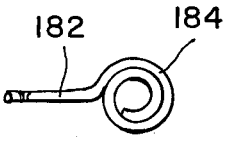
FIG. 11 is a top view of an alternatively preferred form of the first electrical terminal contact member employed in the top-half section of the electrical terminal socket of the invention.
Figure 12:
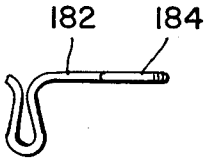
FIG. 12 is a view in elevation of the electrical terminal contact member of FIG. 11.
Figure 13:
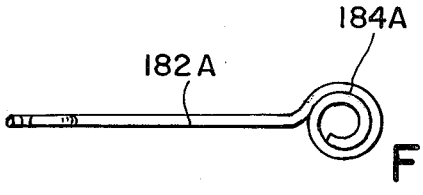
FIG. 13 is a top view of an alternatively preferred form of the second electrical contact member employed in the top-half section of the electrical terminal socket of the invention.
Figure 14:
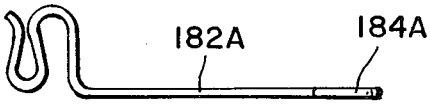
FIG. 14 is a view in elevation of the electrical contact member of FIG. 13.

Referring now particularly to FIGS. 9 and 10 and to terminal contact member 16, the contact-receiving portion 152A thereof comprises a hook-like shape with a relatively narrow neck section 164A and a relatively wide bowl section 166A. Contact-receiving portion 152A is offset or oriented substantially perpendicular with respect to strap portion 154A and terminal plate portion 156, such that, contact-receiving portion 152A, that is, neck section 164A and bowl section 166A, is positioned substantially above a remaining upper surface 155 of strap portion 154A and terminal plate portion 152.

To this end, strap portion 154A extends from terminal portion 156 and merges into a second strap portion 174, which is oriented substantially perpendicular with respect to first strap portion 154A. Second strap portion 174 extends upwards at nearly a right angle from first strap portion 154A into an arched section 176, from which, second strap portion 174 reverses its direction and extends downwards as first jaw 170A. First jaw 170A extends into a first concave curve, from which, it merges into a first convex curve. From a base portion of the first convex curve first jaw segment 170A reverses its direction and extends as second jaw segment 172A into a second convex curve, from which, it extends or merges into a second concave curve. Hence, jaw segments 170A and 172A are bowed towards one another in a concavo-concave configuration to form neck section 164A of contact-receiving portion 152, and are bowed away from one another to form bowl section 166A of contact-receiving portion 152A.

Notably, in each terminal-contact member 16, first strap portion 154A and arc segment 176 together form a return loop which enables each contact receiving portion 152A to be inserted into a corresponding terminal receiving cavity 127A, 127B of top half section 11 while strap portion 154A is received within a corresponding recess 122A, 122B, and terminal plate portion 156 is received in a corresponding bay 86A, 86B with though aperture 162 in registry with screw-terminal recess 40.

As clearly indicated at FIG. 3, it is to be further noted that contact receiving portion 152 of terminal contact member 16 is of greater height than that of contact receiving portion 152 of terminal contact member 14, and further, that segment 154A is of greater length than strap segment 154 of terminal contact member 14. Thus, each terminal contact member 14, by not having a return loop and by having a shorter strap portion 154A and a shorter contact-receiving portion 152 than terminal contact member 16, can only be inserted into its corresponding terminal contact member receiving cavity, recess, and bay, and the same is true of each contact member 16.

In assembling socket 10 of the preferred embodiment, inserts 42, for retaining therein terminal screws 90, are introduced into apertures 40. Bottom-loading terminal contact members 16, are next inserted into their respective cavities 127A, 127B and recesses 122A, 122B through mating surface 96. Top-half section 11, with the inserted terminal contact members 16 disposed therein, is then seated within pan 84 of bottom-half section 12 thus, also seating the terminal plate portions 156 of terminal-contact members 16 into their corresponding bays 86A, 86B on floor 26.

During seating, each guide pin 114 and 116, by virtue of being endowed with different external diameters, is received only within the through aperture 52A and 54B having an internal diameter permitting entry therein. Similarly, during seating, bosses 66 are received in the corresponding counterbores 68 of female threaded recessed apertures 70A, 70B, 72A, and 72B in top-half section 11. Moreover, during seating, each inner edge portion 110 of barriers 74A and 74B, is respectively slidably received within its corresponding slot 106 and 108 at end sides 102 and 104.

Thus, it will be appreciated that guide pins 114 and 116, as well as bosses 66, barriers 74A, 74B and slots 106 and 108 enable top-half section 11 to always be correctly seated within pan 84 with the same left to right orientation. This is important as most of the upright barriers 74A and 74B of lower-half section 12, as well as most of the upright barriers 132A and 132B of top half section 11 are assigned specific terminal contact position numbers. Each terminal contact position number thereof corresponds to another number assigned to each corresponding external conductor to be electrically connected to socket 10 via terminal contact members 14 retained within bays 142A and 142B and 86A and 86B respectively. By maintaining the same left to right orientation during assembly, any possibility of mixing up, unintentionally or otherwise, the prenumbered terminal contact positions associated with barriers 142A and 142B, with respect to the prenumbered terminal contact positions associated with barriers 74A and 74B is completely eliminated, thus also eliminating any possibility of electrically connecting relay 13 to improper external circuits.

It will be noted that mating surface 96 of top-half section 11 and floor surface 26 of bottom-half section 12 are completely and substantially contiguous with one another, when the top-half section is seated within pan 84, except for the openings, as defined by recesses 122A, 122B between the mating, mutually co-extensive surfaces of sections 11 and 12. This arrangement and the further provision of transversely and longitudinally spacing recesses 122A, 122B relative to each other permits each recess 122A, 122B to be completely electrically isolated and insulated from one another.

Additionally, the inserted screws 64 for connecting the top-half and bottom-half sections to one another are completely insulated and isolated from one another and from terminal contact members 14 and 16 by virtue of being surrounded by insulative bosses 66, which in turn are telescopingly received within complementary ones of apertures 70A, 70B, 72A and 72B.

It is also noted that each recess 150A, 150B is completely electrically insulated and isolated from one another and from each recess 122A, 122B by virtue of each latter recess being disposed within lower mating surface 96 and each recess 150A, 150B being recessed within seating surface 94. Recesses 150A, 150B are insulated and isolated from one another by virtue of being both transversely and longitudinally spaced one from the other.

Hence, when top-half section 11 is seated within pan 84, each one of the sixteen terminal-receiving cavities 127A, 127B, 146A, 146B is completely electrically isolated and insulated from one another, and so are the terminal-contact members 14 and 16 when disposed therein and their respective recesses 150A, 150B, 122A, 122B.

Likewise, each bay 86A, 86B on floor 26 is completely electrically isolated and insulated from one another and from bays 142A, 142B near seating surface 94. Bays 86A, 86B are electrically isolated and insulated from one another by virtue of being separated by upright barriers 74A, 74B, that are received within slots 106 and 108, and are located at different corner edges 134 and 138, respectively. Bays 86A, 86B are electrically insulated and isolated from bays 142A, 142B by end sides 102 and 104 and lateral sides 98 and 100. Accordingly, the plate portion of each terminal contact member 16, located in bays 86A, 86B is completely electrically isolated and insulated from one another and from the plate portion of each terminal contact member located in bays 142A, 142B.

Conversely, each bay 142A, 142B at seating surface 94 is completely electrically insulated and isolated from one another and from bays 86A, 86B by virtue of the latter being recessed below surface 94 on borders 136 and 140; being separated by upright barriers 132A, 132B, and being located at different corner edges as well as being upwardly spaced from bays 86A, 86B. Accordingly, the plate portion of each top-loaded terminal contact member 14 disposed therein is also electrically isolated and insulated from one another and from the plate portion of each bottom-loaded terminal contact member 16 positioned between intermated top-half and bottom-half sections 11 and 12.

Following the seating of top half section 11 onto bottom half section 12, the two sections are secured to one another with body assembly screws 64. Screws 64 are inserted into through apertures 58A, 58B and 60A and 60B at the underside of bottom-half section 12 and extend therethrough into threaded engagement with internally threaded portions of apertures 70A, 70B and 72A and 72B associated therewith.

Following the fastening of top and bottom sections 11 and 12 with screws 64, the terminal contact members 14 may be loaded or inserted from seating surface 94, into their proper bays, recesses, and terminal contact member receiving cavities in a manner similar to that as described above in connection with terminal contact members 16.

After the terminal contact members 14, 16 have been inserted into the assembled socket, the terminal screws 90 may be tightened down to secure the plate portion of each contact member against surfaces 136, 140 and 80, 82 in each bay 142A, 142B and 86A, 86B, respectively.

Prior to mounting relay 13 onto socket 10, however, a plug-in-T-shaped orienting pin on relay 13, not shown here, is inserted into a complementary recessed orienting-receiving slot 180 centered within seating surface 94. Relay 13 is then abuttingly sandwiched between each row of barriers 132A and 132B and seated or mounted onto seating surface 94, such that, the orienting pin is received in recessed slot 180, and pin or blade contact members 20 thereof are received in corresponding ones of openings 17, 18. With locking spring 50 snapped into position, relay 13 is positively secured to socket 10 and prevented from lateral rocking by the vertical bracing action afforded by each row of barriers 132A and 132B, and the electrical-mechanical engagement between pin contact members 20 and terminal contact members 14 and 16.

During the mounting of relay 13 onto socket 10, the entry of pin and blade contact members 20 into the contact-receiving portions 152 of terminal contact members 14 is facilitated by a slight outward directed flaring of each of its jaws 170 and 172 in diametrically opposed directions, at the top of neck segment 164. Similarly, jaws 170A and 172A of neck segment 164 also flare slightly outwards and away from one another, and thus, also facilitate entry of pin contact members 20 into terminal contact members 16 in the same manner. Notably, the full transverse width of each jaw 170 and 172, and 170A and 172A at narrow neck segments 164 and 164A is in full electrical contact with the lateral sides of each pin contact member 20 received therein, thus, insuring positive gripping between pin contacts 20 and terminal contact members 14 and 16.

It is also noted that badly misaligned pin contact members 20A may be fully inserted into the contact-receiving portion 152 and 152A of each terminal contact member 16 and 14, respectively, and positively secured therein. This is so as the hollows formed by bowl segments 166 and 166A are of sufficient size to receive therein misaligned pin contact members 20 that are bent at any arbitrary angle, with respect to the base surface of relay 12, that is, within limits defined by the remaining properly aligned vertically extending pin contact members 20. For example, terminal contact members 20 cannot receive misaligned ones thereof which form 180° angles with base surface 12. However, this would not occur as the remaining properly aligned pin contact members 20 would prevent misalignments at this angle.

Lastly, terminal connectors, attached to conductors from external circuits, may be introduced at bays 86A, 86B and 142A, 142B and connected via terminal screws 90 and recesses 40 in a secure and known manner to the contact plate portions of the corresponding terminal contact members 14 and 16 of socket 10. To disassemble socket 10, the reverse procedure for assembling block 10 is followed.

Although several preferred embodiments have been herein above described as required by statute, it will be understood that many variations and modifications hereof may occur to those skilled in the art, without departing from the principles of the invention.

For example, in one broad aspect of the invention, as is clearly shown in illustrations 11–14, each bottom and top loading terminal contact members 16 and 14 could be constructed from a round wire-like conductive metal 182, and have a terminal plate portion consisting of a spirally wound flat coil 184 and 184A. The spiral shape has the effect of providing the modified version of terminal contact members 14 and 16 with a plurality of serrated edges on the portion of the terminal contact members 14 and 16 that seats the external conductors. This serrated effect functions to substantially break down the oxidation at the terminal ends of the external conductors. Further, each spirally wound coil sections 182 and 182A are resiliently flexible, thus allowing it to react by yielding in response to the expanding and contracting actions of a current carrying external conductor. This helps substantially to reduce deformation or loosening of the terminal ends at the external conductors.

Additionally, each recess 150A, 150B in seating surface 94 could be provided with a small recessed transverse extending slot 186 near each portion of seating surface 94 where each recess 150A, 150B opens into its corresponding bay 142A, 142B. After top-loading terminal contact members 14 have been seated in their related terminal-receiving cavities, recesses, etc., a portion of the inside wall portion of each slot 186 may locally be heated to cause the plastic material to be displaced onto the top surface of the strap portion 154 of each terminal contact member 14 such that when the material cools and solidifies within slots 186 there is provided an additional means to lock and secure top-loading terminal contact members 14 at strap portions 154 within seating surface 94.

Accordingly, it is desired that the subject invention be limited only by the spirit and scope of the appended claims.

I claim:

1. An electrical socket for use with electrical devices such as relays, which comprises:

(a) a first section and a second section, said first section being adaptable for being interconnected with said second section, said first section having floor means for receiving therein said second section;

(b) said second section being adapted to be seated on said floor means, said second section having first and second sides and comprising at least one first terminal-receiving cavity disposed in said first side, and at least one second terminal-receiving cavity disposed in said second side, said at least one first terminal-receiving cavity and said at least one second terminal-receiving cavity being juxtaposed within said second section so as to be electrically insulated and isolated from one another, said at least one first terminal-receiving cavity being adaptable for receiving therein a first corresponding contact member of said electrical device through a first opening in said first side of said second section and said at least one second terminal-receiving cavity being adaptable for receiving therein a second corresponding contact member of said electrical device through a second opening in said first side of said second section, and said first terminal-receiving cavity being adaptable to receive a first corresponding external conductor within interior confines of said first side, said second terminal-receiving cavity being adaptable to receive a different second corresponding external conductor within interior confines of said second side and said first section, said first and second external conductors adapted to be received within said interior confines of said first side and within said interior confines of said second side and said first section, respectively, so as to be electrically insulated and isolated from one another.

2. The electrical socket as recited in claim 1, wherein said at least one first terminal-receiving cavity includes an elongated first passage recessed within said first side, said first passage extending in a longitudinal direction from said at least one first terminal-receiving cavity, and wherein said at least one second terminal-receiving cavity includes an elongated second passage recessed within said second side, said second passage extending in a longitudinal direction from said at least one second-terminal-receiving cavity, said first terminal-receiving cavity and said first passage having disposed therein a corresponding one of first terminal members, said second terminal-receiving cavity and said second passage having disposed therein a different corresponding one of second terminal members.

3. The electrical socket as recited in claim 2, wherein said first passage extends between said at least one first terminal-receiving cavity and at least two adjacently spaced first upright barriers, said at least two spaced first upright barriers defining a first bay thereinbetween, said first bay being adaptable for electrically connecting therein said corresponding one of said first terminal members and an external conductor, said first passage defining a recessed third opening in said first side leading from said first bay to said at least one first terminal-receiving cavity.

4. An electrical socket for use with electrical devices such as relays, which comprises:

(a) a first section and a second section, said first section being adaptable for being interconnected with said second section, said first section having floor means for receiving therein said second section;

(b) said second section being adapted to be seated on said floor means, said second section having first and second sides and comprising at least one first terminal-receiving cavity disposed in said first side, and at least one second terminal-receiving cavity deposed in said second side, said at least one first terminal-receiving cavity and said at least one second terminal-receiving cavity being juxtaposed within said second section so as to be electrically insulated and isolated from one another, said at least one first terminal-receiving cavity being adaptable for receiving therein a first corresponding contact member of said electrical device through a first opening in said first side of said second section, and said at least one second terminal-receiving cavity being adaptable for receiving therein a second corresponding contact member of said electrical device through a second opening in said first side of said second section, wherein said at least one first-terminal receiving cavity includes an elongated first passage recessed within said first side, said first passage extending in a longitudinal direction from said at least one first terminal-receiving cavity, and wherein said at least one second terminal-receiving cavity includes an elongated second passage recessed within said second side, said second passage extending in a longitudinal direction from said at least one second terminal-receiving cavity, and wherein said first passage extends between said at least one first terminal-receiving cavity and at least two adjacently spaced first upright barriers, said at least two spaced first upright barriers defining a first bay thereinbetween, said first bay being adaptable for receiving therein a corresponding first terminal member disposed within said first terminal-receiving cavity, said first passage defining a recessed third opening in said first side leading from said first bay to said at least one first terminal-receiving cavity, wherein, said first section further comprises at least two adjacently spaced upright second barriers located on said floor, said at least two spaced second upright barriers defining a second bay thereinbetween, said second bay adaptable for receiving therein a different corresponding second terminal member disposed within said second terminal-receiving cavity, and wherein said second passage is positioned within said second side to define a fourth opening between surfaces of said first section and said second section when said first section and said second section are interconnected.

5. The electrical socket as recited in claim 4 wherein, said second section comprises at least two spaced recessed slots adaptable for slidably receiving therein said at least two spaced second upright barriers when said first and second sections are said interconnected.

6. The electrical socket as recited in claim 5, wherein said at least one second terminal-receiving cavity comprises two pluralities of transversely spaced second terminal-receiving cavities, each said plurality of second terminal-receiving cavities being positioned astraddle a transverse center line of said second section, and wherein each said at least one first terminal-receiving cavity comprises two pluralities of transversely spaced first terminal-receiving cavities, each said plurality of first terminal-receiving cavities being positioned astraddle said two pluralities of second terminal-receiving cavities.

7. The socket as recited in claim 6, wherein said at least two adjacently spaced first upright barriers comprises two pluralities of transversely spaced first upright barriers, each said plurality of first upright barriers transversely extending along opposed corner edges of said one side, and wherein said at least two adjacently spaced second upright barriers comprises two pluralities of transversely spaced second upright barriers, each said plurality of second upright barriers transversely extending along opposed corner edges of said floor.

8. The socket as recited in claim 7, wherein in each plurality of first terminal-receiving cavities includes a like plurality of first passages, and each plurality of transversely spaced first upright barriers includes several first sets of said two adjacently spaced first upright barriers, each said first set defining one of said first bays, each said one of said first passages of said pluralities of first passage further defining one of said third opening of a corresponding said one one of said first bays.

9. The socket as recited in claim 8, wherein each plurality of second terminal-receiving cavities includes a like plurality of said second passages, and each plurality of transversely spaced second upright barriers include several second sets of said two adjacently spaced first upright barriers, each said second set defining one of said second bays, each said one of said second passages of said pluralities of passages further defining one of said fourth openings for a corresponding said one one of said second bays.

10. The socket as recited in claim 9 wherein each of said two pluralities of first upright barrier include portions thereof that are elevated above said first side, each of said pluralities of second upright barriers being longitudinally spaced from one another to form a recess between said elevated portions thereof, said recess being adaptable for receiving snuggly therein said electrical device, said elevated portions of each of said two pluralities of second upright barriers bracing said electrical device when seated within said recess so as to prevent rocking thereof.

11. The socket as recited in claim 10 wherein, each of said first and second terminal-receiving cavities contains therein said first and second terminal members respectively, each said first and second terminal member being adaptable for receiving therein a corresponding contact member of said electrical device.

12. A socket as recited in claim 11 where, each said first and second terminal member comprises a platform portion, adaptable for receiving therein a corresponding connector of a conductor element and adaptable for disposing into a corresponding one of said first and second bays respectively; a strap portion, extending from said platform portion and adaptable for disposing into a corresponding one of said first and second passages respectively; and a contact-receiving portion, extending from said strap portion and adaptable for disposing in a corresponding one of said first and second terminal-receiving cavities respectively.

13. A socket as recited in claim 1 wherein said terminal members are of one-piece and comprise: platform portions adaptable for receiving thereon connectors of conductor elements; strap portions, extending from said platform portions; and a contact-receiving portion, extending from said strap portions and adaptable for disposing in said at least one first and second terminal-receiving cavities and for receiving therein said corresponding contact members.

14. The socket as recited in claim 13 wherein said contact-receiving portion forms a step-like offset with respect to said strap portions and said platform portions, said contact-receiving portions being curved to form two jaw segments, said two jaw segments being bowed toward one another in a biconvex configuration at a first section first of said contact-receiving portions where said corresponding contact members enter into said contact-receiving portions, and being bowed away from one another in a biconcave configurations in a second section of said contact-receiving portions, said second section extending vertically from said biconvex first section, said biconcave second section being of sufficient volume to receive therein misaligned ones of said corresponding contact members.

15. The socket as recited in claim 14 wherein said two jaws flare away from one another at said biconvex section so as to facilitate entry therein of said corresponding contact members.

16. A socket as recited in claim 15 wherein said terminal members comprise a first terminal member, said first terminal member being adaptable for insertion into said at least one first terminal-receiving cavity and comprises a second terminal member, said second terminal member being adaptable for insertion into said at least one second terminal-receiving cavity.

17. The socket as recited in claim 16 wherein each said second terminal member comprises a return loop for enabling said second terminal member to be inserted into said at least one second terminal-receiving cavity, each said return loop comprising a second strap portion extending from said first strap portion, each said second strap portion being offset substantially perpendicular to each said first strap portion each said second strap portion merging into said a first jaw of each said two jaws in an arc-shaped section.

18. The socket as recited in claim 17 wherein said strap portions of said first terminal members are of lesser lengths than said strap portions of said second terminal members; said contact-receiving portions of said first terminal members are of lesser vertical lengths than said contact-receiving member of said second terminal members; and said contact-receiving portions of said first terminal members are perpendicularly offset with respect to top surfaces of said strap portions and said platform portions, while said contact-receiving portions of said second terminal members, including said return loops are perpendicularly offset with respect to a bottom surface of said strap portions and said platform.

19. The electrical socket as recited in claim 3 wherein, said first section further comprises at least two adjacently spaced upright second barriers located on said floor, said at least two spaced second upright barriers defining a second bay therein, said second bay being adaptable for electrically connecting therein a different corresponding one of said second terminal members and a different corresponding external conductor, and wherein said second passage is positioned within said second side to define a fourth opening between adjoining surfaces of said first section and said second section when said first section and said section are interconnected.

20. An electrical socket for use with electrical devices such as relays, which comprises:

(a) a first section and a second section, said first section being adaptable for being interconnected with said second section, said first section having floor means for receiving therein said second section;

(b) said second section having first and second oppositely facing sides and being adapted to be seated on said floor means with said second side confronting said floor means and with said first side being transversely spaced therefrom, said second section comprising at least one first terminal-receiving cavity disposed in said first side and at least one second terminal-receiving cavity disposed in said second side, each of said first and second cavities having a respective terminal receiving portion extending through a third side of said second section, said third side extending between said first and second sides of said second section, said at least one first terminal-receiving cavity and said at least one second terminal-receiving cavity being juxtaposed within said second section in spaced relation from one another so as to be electrically insulated and isolated from one another, and wherein a plane substantially normal to said third side and to either said first or second side passes through said third side and intercepts both said first and said second terminal-receiving cavities, said at least one first terminal-receiving cavity being adaptable for receiving therein a first corresponding contact member of said electrical device through a first opening in said first side of said second section, and said at least one second terminal-receiving cavity being adaptable for receiving therein a second corresponding contact member of said electrical device through a second opening in said first side of said second section.

21. An electrical socket for use with electrical devices such as relays, which comprises:

(a) a first section and a second section, said first section being adaptable for being interconnected with said second section, said first section having floor means for receiving therein said second section;

(b) said second section being adapted to be seated on said floor means, said second section having first and second sides and comprising at least one first terminal-receiving cavity disposed in said first side and at least one second terminal-receiving cavity disposed in said second side, and at least one second terminal-receiving cavity being juxtaposed within said second section so as to be electrically insulated and isolated from one another, said at least one first terminal-receiving cavity being adaptable for receiving therein a first corresponding contact member of said electrical device through a first opening in said first side of said second section, and said at least one second terminal-receiving cavity being adaptable for receiving therein a second corresponding contact member of said electrical device through a second opening in said first side of said second section, said first terminal-receiving cavity having disposed therein a corresponding one of first terminal members, said second terminal-receiving cavity having disposed therein a different corresponding one of second terminal members, and wherein an end portion of said first terminal member for connecting to a corresponding external conductor is supported within a recess in an upper portion of said second section, and an end portion of said second terminal member for connecting to a different corresponding external conductor is supported within a recess defined by a lower portion of said second section and by a portion of said floor.

22. An electrical socket for use with electrical devices such as relays, which comprises:

(a) a first section and a second section, said first section being adaptable for being interconnected with said second section, said first section having floor means for receiving therein said second section;

(b) said second section being adapted to be seated on said floor means, said second section having first and second sides and comprising at least one first terminal-receiving cavity disposed in said first side and at least one second terminal-receiving cavity disposed in said second side, said at least one first terminal-receiving cavity and said at least one second terminal-receiving cavity being juxtaposed within said second section so as to be electrically insulated and isolated from one another, said at least one first terminal-receiving cavity being adaptable for receiving therein a first corresponding contact member of said electrical device through a first opening in said first side of said second section, and said at least one second terminal-receiving cavity being adaptable for receiving therein a second corresponding contact member of said electrical device through a second opening in said first side of said second section, said first terminal-receiving cavity having disposed therein a corresponding one of first terminal members, said second terminal-receiving cavity having disposed therein a different corresponding one of said second terminal members, and wherein a portion of said first terminal member for connecting to a corresponding external conductor is supported by an upper portion of said second section, and a portion of said second terminal member for connecting to a different corresponding external conductor is supported by a portion of said floor; and wherein said first side includes at least two spaced, upright barriers defining a first bay thereinbetween, said first bay being spaced from a corresponding said at least one first terminal-receiving cavity, and wherein said first section includes at least two spaced, second upright barriers defining a second bay thereinbetween, said second bay being spaced from a different corresponding said at least one second terminal-receiving cavity, said upper portion of said second section being in a region of said corresponding first bay and said portion of said floor being in a region of said corresponding second bay.

* * * * *